United States Patent [19]

Day

[11] Patent Number: 4,487,371

[45] Date of Patent: Dec. 11, 1984

[54] COMMINUTION APPARATUS

[76] Inventor: Thomas E. Day, 315 North 100 East, North Salt Lake, Utah 84054

[21] Appl. No.: 377,653

[22] Filed: May 13, 1982

[51] Int. Cl.[3] ..... B02C 18/10; B02C 23/34

[52] U.S. Cl. ..... 241/48; 241/62; 241/74; 241/89.1; 241/282.1

[58] Field of Search ..... 241/74, 85, 87, 88.4, 241/89.1, 89.3, 91, 6, 277, 278 A, 57, 49, 51, 61, 30, 1 B, 282.1, 282.2, 48, 62

[56] References Cited

U.S. PATENT DOCUMENTS 1,634,026 6/1927 Fritz ..... 241/74
3,251,389 5/1966 Urschel et al. ..... 241/95 X

FOREIGN PATENT DOCUMENTS 944281 6/1956 Fed. Rep. of Germany ..... 241/89.3
2640326 3/1978 Fed. Rep. of Germany ..... 241/74
691189 10/1979 U.S.S.R. ..... 241/74

*Primary Examiner*—Mark Rosenbaum
*Attorney, Agent, or Firm*—J. Winslow Young

[57] ABSTRACT

A novel comminution apparatus and method for comminuting a granular feed into a product having a predetermined particle size. The comminution apparatus includes a high-speed cutter member operating inside a screen enclosure having adjustable openings in the screen enclosure. A lever arm is used to adjust the relative openings between an inner screen and an outer screen of the screen enclosure with the size of the openings in the screen enclosure predetermining the particle size range passing therethrough. Rotation of the cutter member creates an air flow outwardly through the screen enclosure while an air recycle system directs the airflow across the outlet to a feed hopper to carry the particulate feed into contact with the cutter assembly.

10 Claims, 2 Drawing Figures

COMMINUTION APPARATUS

BACKGROUND

1. Field of the Invention

This invention relates to comminution apparatus and, more particularly, to a comminution apparatus and method for grinding a granular material such as a grain and is selectively adjustable to produce a product of a preselected particle size, the particle size ranging between a fine flour and a coarse particle.

2. The Prior Art

Throughout history, civilization has depended upon the harvest, storage and ultimate consumption of food grains such as corn, wheat, barley, rice, and the like. With minor exceptions, most grains are finely ground or otherwise reduced in particle size, ranging from a coarse meal to a fine flour, before being consumed either in its present state or incorporated into a food product. The grinding process alone consumes a considerable amount of time for the person responsible for this task. Historically, the fine grinding of a granular material such as a food grain was accomplished by engaging the grain between two grinding surfaces. The grinding surfaces are usually in the form of millstones or the like so that the fine grinding is done by the frictional engagement of the grain by relative movement of the grinding surfaces. This grinding process has evolved in time to produce on a commercial scale a very fine, uniform product. However, this type of grinding equipment is heavy, relatively expensive to manufacture and maintain and results in wear of the grinding surfaces with the worn material passing into the food product. Also, this particular grinding process contributes a substantial amount of heat to the flour product with a corresponding reduction in the nutritive value of the flour product.

One alternative device consists of a plurality of mating rows of perpendicular teeth on a stator and matching, corresponding rows of teeth mounted perpendicularly on a rotor. Grain is fed between the teeth and is thus ground or otherwise finely comminuted without much heating of the resulting product. The fineness of the resulting product is regulated by the rate of air flow with the grain introduced through the grain feed port. The result is poor control of the ratio of coarseness to fineness of the product. Furthermore, this device, because of its net production of an airflow, results in dust being dispensed into the atmosphere. Further, the device tends to be relatively noisy due to construction of the high speed motor used to drive the rotor as well as the exhaust air allowing the escape of noise from the apparatus.

Certain other prior art devices are known in the art and are disclosed in the following references:

Fritz (U.S. Pat. No. 1,634,026) discloses a feed cutter and grinder for grinding hay, grain, and the like. The grinder consists of a cylindrical housing with a plurality of holes 9 therethrough. A circumscribing band 10 with corresponding holes surrounds the housing and is adjustable to regulate the size of the openings 9. A plurality of cutter bars 25 are mounted on a shaft 24 (best seen in FIG. 1) and operate as beater bars to provide the grinding/cutting action.

Ellis (U.S. Pat. No. 2,641,971) discloses a paper stock pulper which operates as a blender-type apparatus inside a screen having three lobes (best seen in FIGS. 3 and 4) therein to redirect the paper stock back to the impellor. The description of this apparatus is best seen at column 3, lines 6–22.

Ward (U.S. Pat. No. 2,822,846) discloses a leaf grinder for grinding leaves for mulching and having a set of horizontally rotatable blades 47, 49, and 51 operating inside a cylindrical screen 35. The screen is of fixed size, as in the previous reference, and predetermines the size of particles to pass through the screen.

Heger (U.S. Pat. No. 3,386,670) discloses a grinding apparatus for milling of ceral grains wherein the comminuting blade rotates in a horizontal plane at a high speed and is surrounded by a sieve structure. The fineness of the meal obtained from this device is varied by providing the sieve structures interchangeably within the housing. Note also that the blade operates at the lower end of a feed column which, in turn, is surrounded by the screen structure.

It would, therefore, be a significant advancement in the art to provide a novel apparatus and method for comminuting a granular material to a predetermined degree of fineness in the absence of a net production of byproduct air and with a corresponding reduction in dust and noise. It would also be an advancement in the art to provide a novel comminution apparatus and method for comminuting a granular feed with a rotating cutter mechanism operating inside a screen enclosure wherein the size of the screen openings are selectively adjustable to readily produce a comminuted product having a predetermined size range. Such a novel apparatus and method is disclosed and claimed herein.

BRIEF SUMMARY AND OBJECTS OF THE INVENTION

The present invention relates to a novel comminution apparatus and method wherein a motor-drive cutter assembly operates inside a screen-like enclosure. The screen members of the screen-like enclosure each have openings that are selectively adjustable relative to corresponding openings to thereby allow the user to selectively regulate the opening size to control the size of the resulting comminuted product. Granular feed is transported with an air stream through a conduit to the cutter assembly. An air recycle system precludes the net production of air thus reducing noise and dust. A venturi mechanism is included in the air recycle system to aid in drawing granular feed from the feed hopper through venturi action into the conduit. The screen members are designed to cooperate telescopically in close-fitting relationship with each having axially oriented slots that are adjustable relative to each other to selectively adjust the particle size passing through the screen. The inner screen is rotatably movable relative to the outer screen. A lever arm is mounted to the inner screen to permit selective adjustment of the inner screen relative to the outer screen.

It is, therefore, a primary object of this invention to provide improvements in comminution apparatus for comminuting a granular material.

Another object of this invention is to provide improvements in the method of comminuting a granular material.

Another object of this invention is to provide a novel comminution apparatus having a motor-driven cutter assembly operating inside a screened enclosure.

Another object of this invention to provide a novel, adjustable screen apparatus around the cutter assembly to thereby provide a mechanism for selectively regulating the fineness of the product passing through the screen apparatus.

Another object of this invention is to provide a novel, enclosed, air recycle stream for the comminution apparatus to thereby aid in carrying granular material to the cutter assembly while reducing dust and noise in the absence of a net production of air flow.

These and other objects and features of the present invention will become more fully apparent from the following description and appended claims taken in conjunction with the accompanying drawing.

DETAILED DESCRIPTION OF THE PREFERRED EMBODIMENTS

Figure 1:
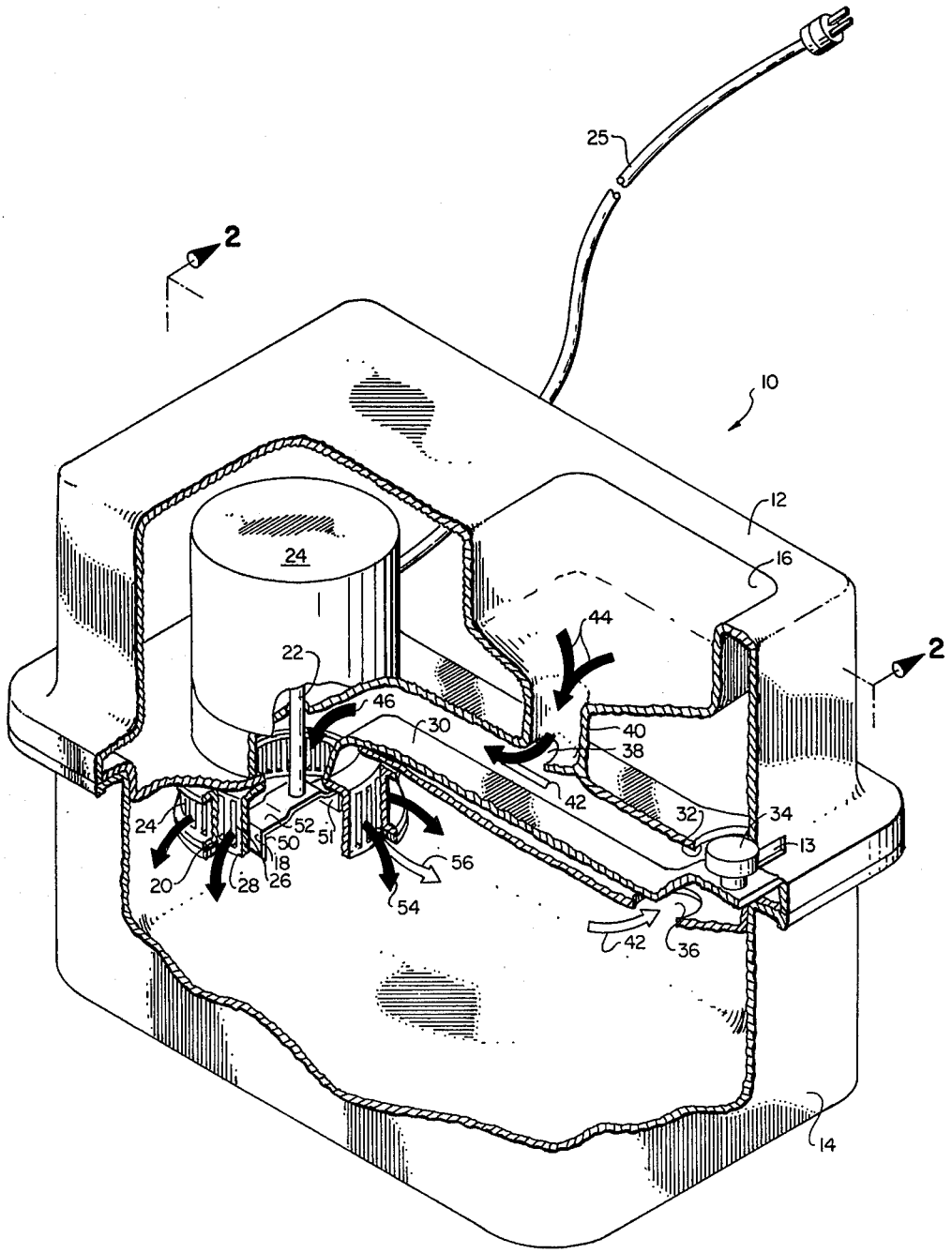
FIG. 1 is a perspective view of the comminution apparatus of this invention shown with portions broken away to illustrate internal features.
Figure 2:
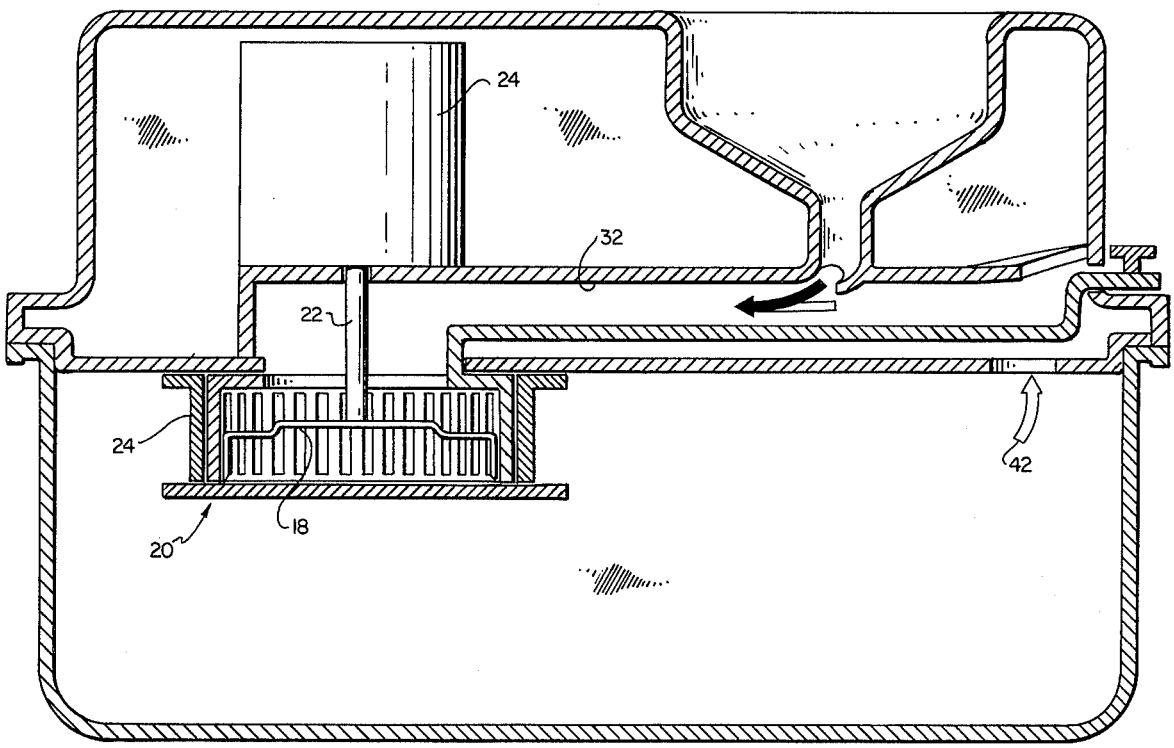
FIG. 2 is a partial, cross sectional view taken along lines 2—2 of FIG. 1.

The invention is best understood by reference to the drawing wherein like parts are designated with like numerals throughout.

Referring now more particularly to the drawing, a presently preferred embodiment of the novel comminution apparatus of this invention is illustrated generally at 10 and includes a housing 12 releasably mounted on a pan-like container 14. A feed hopper 16 is formed in the upper surface of housing 12 and serves as a feed reservoir for the granular material (not shown) to be comminuted by comminution apparatus 10. A comminution mechanism includes a cutter assembly 18 mounted inside a screen enclosure 20. Cutter assembly 18 is mounted to the end of a shaft 22 extending downwardly from a motor 24 enclosed inside housing 12.

Screen assembly 20 includes an outer screen 24, an inner screen 26 and a bottom plate 28 enclosing the lower end of outer screen 24. Inner screen 26 and outer screen 24 each include matching, elongated slots extending longitudinally parallel to the axis of the cylinder formed by screen assembly 20. The elongated slots formed in screen assembly 20 provide a relatively enlarged screen capacity thereby substantially reducing any tendency for screen assembly 20 to become plugged by product. Conversely, if screen assembly 20 were configurated with circular holes, the tendency to plug would increase dramatically by reason of the geometry of the holes as they are offset relative to each other. Inner screen 26 is adjustably rotatable inside outer screen 24 and is mounted to a lever 30 to accommodate the user (not shown) adjustably shifting lever 30 to thereby selectively adjust the orientation of slots in inner screen 26 relative to outer screen 24 as will be discussed more fully hereinafter.

Lever 30 is mounted inside a conduit 32 and extends outwardly through a slot 13 in the wall of housing 12. Movement of lever 30 is accomplished by grasping knob 34 on lever 30 and moving the same either right or left, thereby selectively adjusting the orientation of inner screen 26 relative to outer screen 24.

Conduit 32 includes an air recycle inlet 36 and a feed port 38 communicating with an outlet 40 from hopper 16. The orientation of feed port 38 is such that flow of air (indicated schematically herein as air flow arrow 42) across feed port 38 creates a venturi-like action drawing grain (not shown), but indicated schematically at arrow 44) into conduit 32 with the assistance of gravity and carrying the same into screen enclosure 20. The combined stream of recycle air 42 and grain 44 is indicated schematically as feed stream 46 which passes downwardly into contact with the cutter assembly 18 operating at high speed inside screen enclosure 20.

Cutter assembly 18 is driven at a very high rate of speed by motor 24. Cutter assembly 18 includes downwardly extending cutter arms 50 and 51 at each end of a horizontal bar 52. Cutter arms 50 and 51 closely sweep the internal wall of inner screen 26 and serve as the cutting mechanism whereby the granular feed 44 is reduced in size. The degree to which the granular feed is contacted by cutter arms 50 and 51 is controlled by the size of the relative openings between inner screen 26 and outer screen 24. For example, if a finely divided product is desired, inner screen 26 is selectively adjusted relative to outer screen 24 so that only a very narrow opening is available for the passage of particulate product therethrough into containwer 14. With only a narrow slot available for escape of the particulate product, coarser particles are continually exposed to the cutting action of cutter assembly 18 with the result that a very fine, flour-like product is obtained. Correspondingly, a coarser product is obtained by selectively adjusting the width of the relative openings between inner screen 26 and outer screen 24 to thereby allow coarser particles to escape while retaining only the very coarsest particles inside screen enclosure 20 for continued contact with cutter assembly 18.

The production of comminuted particles is indicated schematically at arrow 54. Particles 54 settle to the bottom of container 14 while the separated air 56 is recycled as recycle air 42. It is, therefore, readily apparent that there is no net production of air by the apparatus and method of comminution apparatus 10 and, further, that any noise produced by cutter assembly 18 is greatly reduced since there is no direct passageway for escape of noise to the outside from comminution apparatus 10.

THE METHOD

The method of this invention includes placing a granular feed 44 in hopper 16, providing electrical power to motor 24 through an electrical conduit 25 and selectively positioning lever 30 by movement of knob 34 so as to produce the desired product size range. During operation, recycle air flow 42 passes upwardly through recycle air inlet 36 and by venturi action draws feed 44 through feed outlet 38 and carries the same downwardly into screen enclosure 20. Feed 44 is contacted by the rapidly turning cutter assembly 18 and thereby suitably reduced in size. It should be noted that there is a spatial separation between cutter bar 52 and the upper surface of screen enclosure 20, thereby allowing the granular feed 44 to be dispersed outwardly into contact with rapidly turning cutter bars 50 and 51. Feed 44 and any relatively large particulate material not reduced in size by the action of cutter assembly 18 is continually recycled into contact with cutter bars 50 and 52 until suitably reduced in size. Thereafter, the outward flow of discharge air 56 carries the fine particles through screen assembly 20 and deposits the same in container 14. Upon completion of the comminution cycle, electrical power is shut off from motor 24 and the user merely lifts housing 12 away from container 14 thus providing complete access to the finely reduced product.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A comminution apparatus comprising:
a rotatable, motor-driven cutter member;
a first screen member surrounding the cutter member, the first screen member having a plurality of elongated slots;
a second screen member enclosing the first screen member in closely spaced relationship therewith, the second screen member having a plurality of elongated slots;
actuator means for selectively positioning said slots of the first screen member relative to said slots of the second screen member;
feed means for introducing a feed into an enclosure formed by said first screen member around the cutter member, comprising a hopper for the feed, an outlet from the hopper and a conduit extending between the outlet and the enclosure; and
air recycle means for directing an air flow into the conduit past the outlet into the enclosure and back into the conduit.

2. The comminution apparatus defined in claim 1 wherein the cutter member comprises a basal member having cutting arm extending from each end of the basal member.

3. The comminution apparatus defined in claim 2 wherein the basal member is affixed at its midpoint to a vertically oriented shaft so as to be rotatable in a horizontal plane and the cutting arms extend downwardly from the basal member and sweep the inside of the first screen member.

4. The comminution apparatus defined in claim 1 wherein the first screen member and the second screen member each comprise a cylindrical shape and said elongated slots in each said screen member are arrayed generally parallel to the axis of the cylinder.

5. The comminution apparatus defined in claim 4 wherein the second screen member comprises a closure over the end of the second screen member, the closure enclosing the cutter member inside the screen members.

6. The comminution apparatus defined in claim 1 wherein the conduit forms a passageway for said actuator means.

7. The comminution apparatus defined in claim 1 wherein the outlet comprises a venturi means and the air flow thereby creates a venturi action to draw feed from the hopper through the venturi means.

8. The communition apparatus defined in claim 1 wherein the comminution apparatus further comprises a receiving bin enclosing said first and second screen members and receiving a comminuted feed passing through said first and second screen members, said comminuted feed being produced by said cutter member comminuting said feed.

9. A comminution apparatus comprising:
an upper housing, the upper housing forming a feed hopper;
a lower housing adapted to receive the upper housing in nesting relationship, the lower housing serving as a receiving bin for a comminuted feed;
an electric motor mounted inside the upper housing and having a drive shaft extending downwardly into the lower housing;
a cutter member mounted on the drive shaft, the cutter member comprising a horizontally rotatable basal member and a cutting arm extending downwardly from each end of the basal member;
an inner, cylindrical screen member surrounding the cutter member in relatively close spaced relationship to the cutter member and comprising a plurality of elongated slots aligned generally parallel to the axis of the inner screen member;
an outer, cylindrical screen member surrounding the inner screen member in relatively closed spaced relationship and comprising a plurality of elongated slots aligned generally parallel to the axis of the outer screen member;
a closure across the lower end of the outer screen member;
actuator means for rotating the inner screen member relative to the outer screen member thereby selectively adjusting the relative orientation of the slots of the inner screen member with respect to the slots of the outer screen member; and
conduit means between the feed hopper and the cutter member for directing a feed from the feed hopper into the cutter member, the conduit means comprising an air recycle means for recycling air serially through the conduit means and the inner and outer screen members, the air carrying at least a portion of the feed to the cutter member.

10. The comminution apparatus defined in claim 9 wherein the feed hopper comprises an outlet into the conduit means and the outlet comprises a venturi means for accommodating the air flow drawing at least a portion of the feed from the hopper into the conduit means.

* * * * *